US006082329A

United States Patent [19]

Kazumasa

[11] Patent Number: 6,082,329

[45] Date of Patent: Jul. 4, 2000

[54] ENGINE SPEED CONTROL METHOD AND CONTROLLER THEREFOR

[75] Inventor: Inoue Kazumasa, Tokyo, Japan

[73] Assignee: Mitsubishi Denki Kabushiki Kaisha, Tokyo, Japan

[21] Appl. No.: 09/201,889

[22] Filed: Nov. 30, 1998

[30] Foreign Application Priority Data

May 26, 1998 [JP] Japan ..... 10-144720

[51] Int. Cl.[7] ..... F02D 41/16

[52] U.S. Cl. ..... 123/339.18; 123/339.23

[58] Field of Search ..... 123/339.16, 339.17, 123/339.18, 339.23

[56] References Cited

U.S. PATENT DOCUMENTS 4,467,761 8/1984 Hasegawa ..... 123/339.18 X 4,479,471 10/1984 Hasegawa et al. ..... 123/339.22

4,491,108 1/1985 Hasegawa et al. ..... 123/339.16

FOREIGN PATENT DOCUMENTS 5-69973 10/1993 Japan .

*Primary Examiner*—Tony M. Argenbright

*Attorney, Agent, or Firm*—Sughrue, Mion, Zinn, Macpeak & Seas, PLLC

[57] ABSTRACT

To prevent the actual engine speed under idling from excessively increasing or decreasing, an idling-up correction value for correcting an idling-engine-speed control air quantity is obtained as an idling-up correction value correlated with a radiator-fan driving duty (load value) determined by a cooling water-temperature sensor and a vehicle speed. Thereby, the engine speed Ne under idling is controlled.

9 Claims, 9 Drawing Sheets

ENGINE SPEED CONTROL METHOD AND CONTROLLER THEREFOR

BACKGROUND OF THE INVENTION

1. Field of the Invention

The present invention relates to an engine speed control method and controller therefor for controlling the idling engine speed of an engine in accordance with the loaded state of an electric load device.

2. Description of the Prior Art

For example, the Japanese Patent Publication No. 69973/1993 discloses a conventional controller for controlling the speed of an engine in accordance with an electric load. The controller uses an idling-engine-speed feedback control method while a plurality of electric load devices is connected to control the idling speed of an engine correspondingly to the on/off state of the above electric load devices. Particularly, when a plurality of electric load devices is turned on, the idling speed of an engine is controlled by changing intake air quantities to be taken into an engine through the technique for adding a predetermined electric-load correction value to each load.

FIGS. 13(*a*) to 13(*e*) are illustrations showing examples of temporal changes of an idling-engine-speed control air quantity $Q_{ISC}$ and an actual speed Ne when an electric load value (driving duty value) is increased by operating a radiator fan serving as an electric load device to be duty-driven under idling. The idling-engine-speed control air quantity $Q_{ISC}$ is an engine intake air quantity used to control the engine speed under idling. As an electric load value (driving duty value) increases since the input time $t_1$ of an electric load value, the idling-engine-speed control air quantity $Q_{ISC}$ is obtained as a value obtained by further adding a predetermined idling-up correction value $Q_{ELS}$ while duty-driving the radiator fan to the sum of a basic air quantity $Q_{BASE}$ and an engine-speed feedback correction value $Q_{NFB}$.

In FIGS. 13(*a*) to 13(*e*), when the idling-up correction value $Q_{ELS}$ is set to a predetermined value, for example, a driving duty value at a radiator-fan driving duty of 50% but an actual duty output is 90%, the idling-engine-speed control air quantity $Q_{ISC}$ cannot be completely corrected and the actual engine speed Ne suddenly decreases from time $t_1$ as shown in FIG. 13(*e*). Thereafter, as the engine-speed feedback correction value $Q_{NFB}$ is increased due to engine-speed feedback correction, the actual engine speed Ne increases, slowly approaches and converges to a target engine speed Nt, and shifts to a stable state.

Then, when the above electric load is released at time $t_2$ ($t_2n>t_1$), the idling-up correction value $Q_{ELS}$ under duty-driving of radiator fan added at time $t_1$ is subtracted. However, because of increase of the engine-speed feedback correction value $Q_{NFB}$ due to decrease of the actual engine speed Ne between time $t_1$ and time $t_2$, an engine-speed feedback correction value $Q_{NFB2}$ at time $t_2$ becomes larger than an engine-speed feedback correction value $Q_{NFB1}$ at time $t_1$ and during the period for returning the increased value to the original value, the engine speed Ne increases for a while as shown in FIG. 13(*e*). Thereafter, the engine speed $N_e$ is shifted to a stable idling state according to engine-speed feedback correction.

Driving duties while driving a radiator fan normally change between 0 and 100%. In the case of a conventional engine-speed control method, however, the loaded state of an electric load device duty-driven is detected only under on/off state. Therefore, even if a duty output is 10 or 90%, the idling-up correction value $Q_{ELS}$ equal to a load value (driving duty value) under duty driving is added. Therefore, it is impossible to supply a proper electric-load correction value corresponding to an actual load value (driving duty value). That is, in the case of an electric load device to be duty-driven such as a radiator fan, though electric load values are changed correspondingly to change of driving duties, it is only possible to detect an electric load under duty driving similarly to the case in which the electric load device is turned on. Therefore, there are problems that the same electric load correction value is added independently of the electric load value is added and thus, only a correction with excess or deficiency can be performed and therefore, the actual engine speed under idling excessively increases or decreases.

SUMMARY OF THE INVENTION

The present invention is made to solve the above problems and its object is to provide an engine speed control method and controller therefor capable of controlling excessive increase or decrease of the actual engine speed under idling by supplying a proper air quantity corresponding to a load value input to an electric load device to be duty-driven such as a radiator fan.

The engine speed control method of the present invention is characterized by correcting an intake air quantity used to control the engine speed under idling in accordance with the driving duty value of an electric load device at the time of duty-driving the electric load device and thereby controlling the speed of an engine.

The engine speed control method of the present invention is characterized by detecting a loaded state correspondingly to a duty output value for an electric load device.

The engine speed controller of the present invention has electric-load correction-value computing means for computing a correction value of an intake air quantity used to control the engine speed under idling corresponding to the loaded state of an electric load device to be duty-driven, corrects an idling-engine-speed control air quantity in accordance with the correction value, and controls the speed of an engine.

The engine speed controller of the present invention detects the above loaded state in accordance with the duty output value of a circuit for duty-driving an electric device.

The engine speed controller of the present invention is provided with the above electric-load correction-value computing means for each electric load device to be duty-driven when a plurality of electric load devices to be duty-driven is used.

The engine speed controller of the present invention uses the sum of electric-load correction values computed by electric-load correction-value computing means provided for each of a plurality of electric load devices as a correction value of an intake air quantity used to control the engine speed under idling.

The engine speed controller of the present invention uses the maximum electric-load correction value among the electric-load correction values computed by the electric-load correction value computing means provided for each of a plurality of electric load devices as a correction value of an intake air quantity used to control the engine speed under idling.

The engine speed controller of the present invention computes a correction value of an intake air quantity used to control the engine speed under idling in accordance with the sum of electric-load correction values obtained by electric-load correction-value computing means provided for each of a plurality of electric load devices and the maximum output correction value among the output correction values computed by those electric-load correction-value computing means.

The engine speed controller of the present invention uses a value obtained by weighting and summing the electric-load correction values obtained by electric-load correction-value computing means provided for each of a plurality of electric load devices as a correction value of an intake air quantity used to control the engine speed under idling.

DETAILED DESCRIPTION OF THE PREFERRED EMBODIMENTS

Embodiment 1

Figure 1:
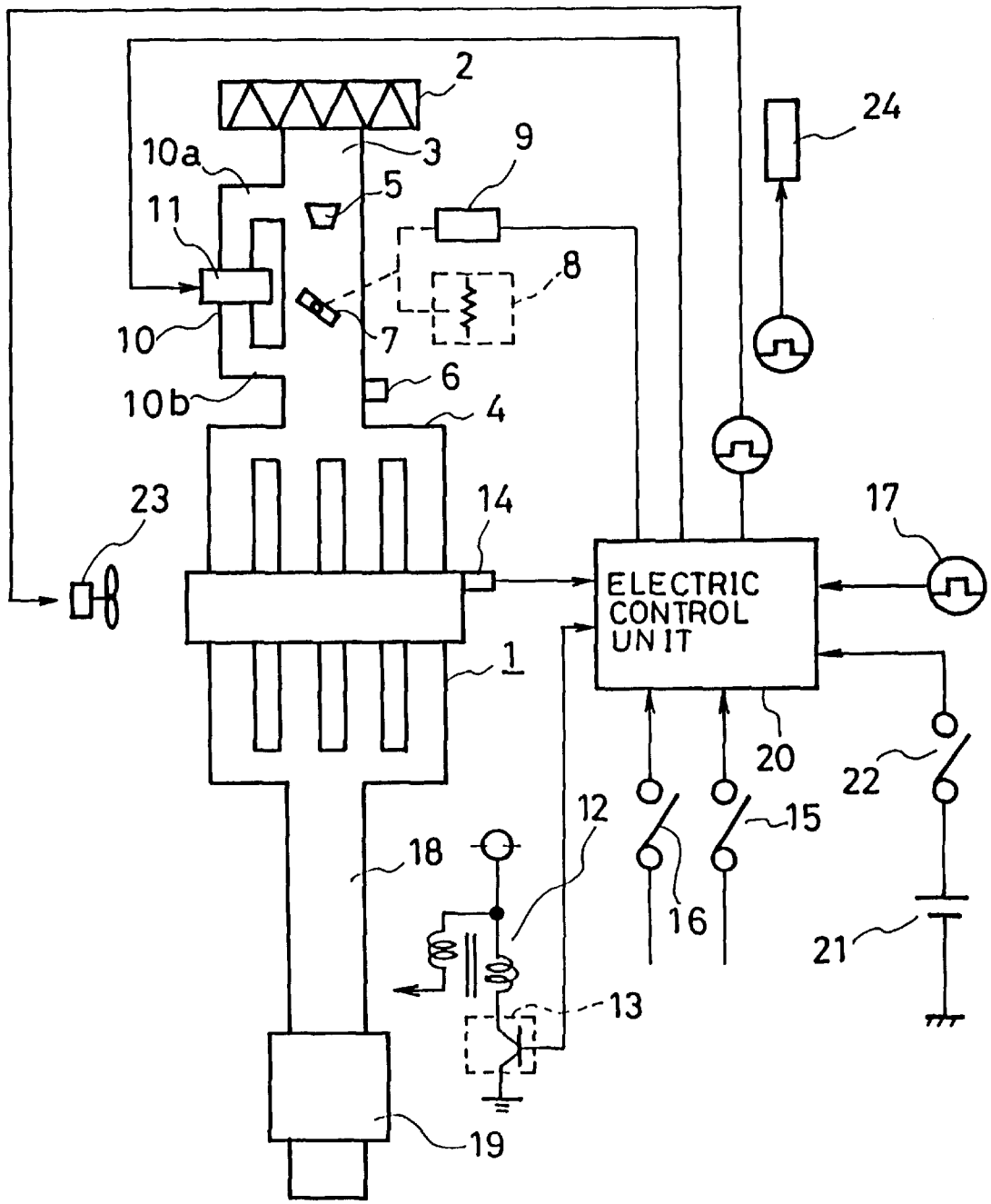
FIG. 1 is a schematic block diagram for explaining the engine speed control method and controller therefor of embodiment 1 of the present invention.

FIG. 1 is a schematic block diagram for explaining the engine speed control method and controller therefor of the embodiment 1 of the present invention. In FIG. 1, Designated at 1 an engine mounted on, for example, a vehicle, which has an air cleaner 2, an intake pipe 3, and an intake branch pipe 4 at the front stage. The intake air to be supplied to the engine 1 is supplied to the engine 1 through the air cleaner 2, intake pipe 3, and intake branch pipe 4 and fuel is injected from a single electromagnetic fuel injection valve 5 provided on the upstream side. The supplied fuel quantity is determined by a fuel control system (not illustrated) in accordance with an output signal of a pressure sensor 6 for detecting the pressure in the intake pipe 3 in absolute pressure.

A throttle valve 7 provided for the downstream side of the electromagnetic fuel injection value 5 to adjust the main intake air quantity of the engine 1 correspondingly to the pedal actuating operation of an accelerator pedal (not illustrated) by a driver, a throttle opening-degree sensor 8 for detecting the opening degree of the throttle valve 7, and an idling switch 9 for detecting the full opening of the throttle valve, which is turned on when the throttle valve fully opens. A bypass conduit 10 provided so as to bypass the throttle valve 7, an air control valve 11 provided for the bypass conduit 10. An end of the bypass conduit 10 is connected to an air introduction port 10*a* provided between the electromagnetic fuel injection valve 5 and the throttle valve 7 and the other end of the bypass conduit 10 is connected to an air exhaust port 10*b* provided for the downstream portion of the throttle valve 7. The air control valve 11 uses, for example, an electromagnetic control valve which has an opening degree corresponding to the duty ratio of an applied driving signal and adjusts the air quantity passing through the bypass conduit 10 by controlling the channel sectional area of the bypass conduit 10 proportionally to the above duty ratio.

Moreover, the ignition device of the engine 1 is connected to an ignition coil 12 and an ignition control system (not illustrated) for generating an ignition signal in accordance with an operation state parameter of the engine 1 and constituted with an igniter 13 comprising a switching element for turning on/off the primary current of the ignition coil 12 correspondingly to the ignition signal, a distributor (not illustrated), and an ignition plug (not illustrated).

A cooling-water temperature sensor 14 for detecting a temperature representing the temperature of the engine 1, for example, the cooling water temperature of a radiator, an electric load switch 15 for inputting the load of an auxiliary machine such as an air conditioner, and a torque converter switch 16 for generating a torque converter signal of an automatic transmission, which generates an off-signal for a neutral range and an on-signal for a drive range. Moreover, a speed sensor 17 for outputting a pulse signal having a frequency proportional to the rotational speed of an axle shaft and detecting a vehicle speed. An exhaust pipe 18 of the engine 1, a catalyst 19 provided in the exhaust pipe 18, which purifies a gaseous mixture changed to an exhaust gas by being burned by the engine 1 and then exhausts the mixture to the outside.

An electronic control unit 20 is operated when electric power is supplied from a battery 21 through a key switch 22, which decides whether the operation state is an idling state in accordance with a signal output from the idling switch 9 or speed sensor 17 and drives the air control valve 11 in accordance with the ignition signal of the primary side of the ignition coil 12, signal sent from the cooling-water temperature sensor 14, or signal sent from the electric load switch 15 or torque converter switch 16 correspondingly to the decision result. The electronic control unit 20 connects with a radiator fan 23 serving as an electric load device and a fuel pump 24. Moreover, symbol 21 denotes a battery and 22 denotes a key switch.

Figure 2:
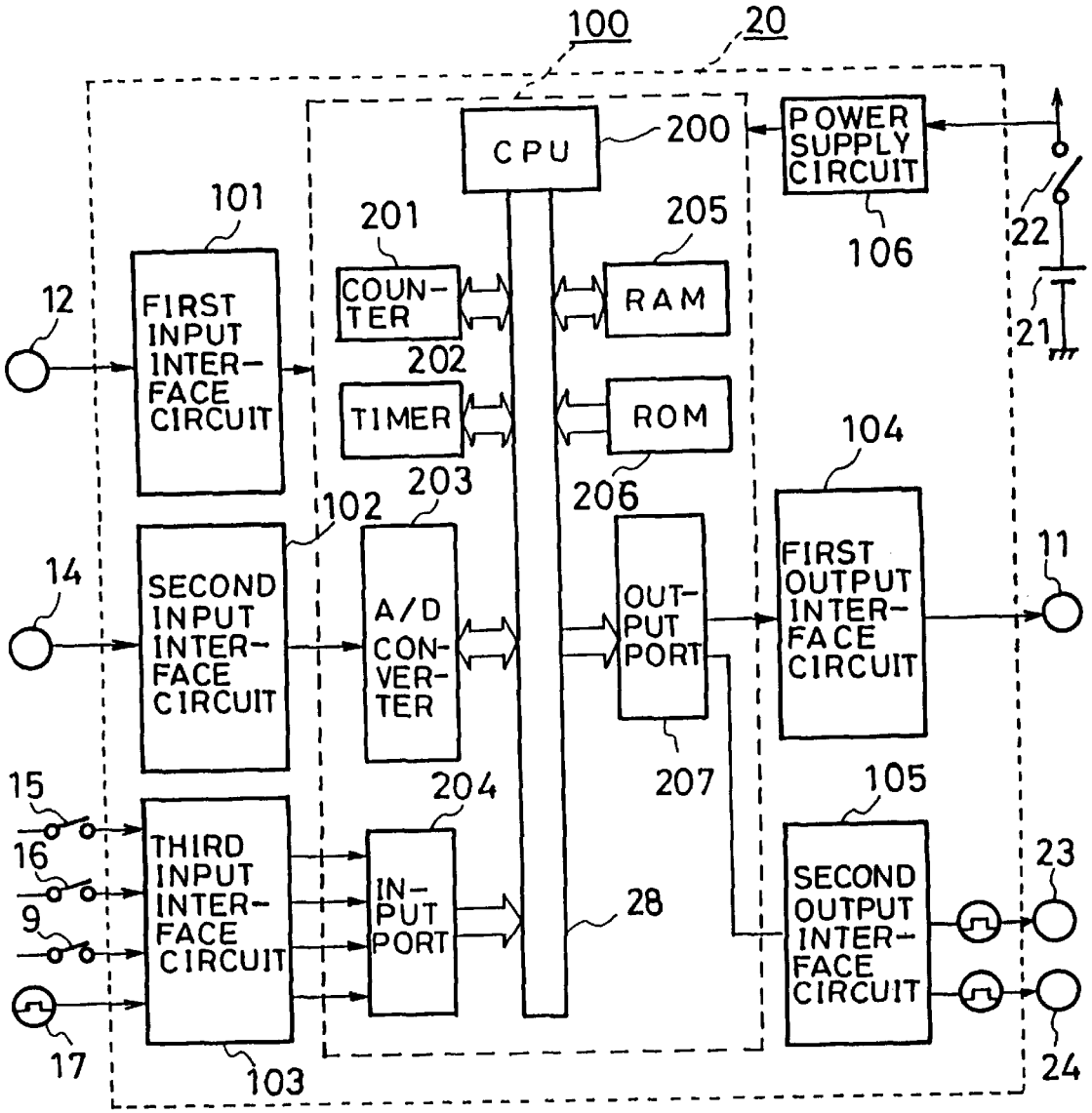
FIG. 2 is a block diagram showing the structure of the electronic control unit of embodiment 1 of the present invention.

FIG. 2 is a block diagram showing the structure of the electronic control unit 20. In FIG. 2, a microcomputer 100 which is provided with a CPU 200 for computing a control variable of the engine speed under idling in accordance with a predetermined program, a free-running counter 201 for measuring the rotation cycle of the engine 1, a plurality of timers 202 for measuring the time every 100 ms used for rotation feedback correction or the duty ratio D of a driving signal to be applied to the air control valve 11, an A-D converter 203 for converting an analog signal input from the cooling-water temperature sensor 14 into a digital signal, an input port 204 for directly inputting a digital signal sent from the idling switch 9 remaining as it is or the like to the CPU 200, a RAM 205 serving as a work memory, a ROM 206 for storing a program based on the flow in FIG. 3, an output port 207 for outputting a driving signal, and a common bus 208.

A first input interface circuit 101 which shapes the waveform of an ignition signal at the primary side of the ignition coil 12 and forms an interrupt signal and inputs the signal to the microcomputer 100. When the interrupt signal is generated, the CPU 200 reads the value of the counter 201, computes the cycle of an engine speed in accordance with the difference between the present counter value and the last counter value, and stores the cycle in the RAM 205.

A second input interface circuit 102 removes noise components from an output signal of the cooling-water temperature sensor 14 and outputs the signal to the A-D converter 203. A third input interface circuit 103 sets a signal such as an on-signal of the electric load switch 15 and of idling switch 9, on-signal sent from the torque converter switch 16, and pulse of the speed sensor 17 to a predetermined level and outputs them to the input port 204.

A first output interface circuit 104 which amplifies a driving signal sent from the output port 207 and outputs it to the air control valve 11. A second output interface circuit 105 which sets a pulse sent from the output port 207 to a predetermined level and outputs it to the radiator fan 23 and fuel pump 24. Symbol 106 denotes a power supply circuit that sets the power supply of the battery 21 to a constant voltage when the key switch 22 is turned on and supplies it to the microcomputer 100.

Then, a method for computing an idling-engine-speed control air quantity $Q_{ISC}$ used to control the engine speed under idling is described below by referring to the flow chart (idling-engine-speed control routine) in FIG. 3. In this case, steps S1 to S3 denote a correcting operation routine F1 for computing an idling-up correction value $Q_{ELS}$ serving as an electric load value for correcting the idling-engine-speed control air quantity $Q_{ISC}$ correspondingly to the loaded state of an electric load device. For this embodiment 1, a case is described in which an electric load device to be duty-driven is only the radiator fan 23.

First, the correcting operation routine F1 computes an idling-up correction value $Q_{ELS}$. That is, in step S1, the idling-up correction value $Q_{ELS}$ under duty-driving of the radiator fan is initialized to 0. Then, in step S2, it is decided whether the radiator fan 23 is currently driven. When the radiator fan is not currently driven, the correcting operation routine F1 is interrupted and step S4 is started. When the radiator fan is currently driven, the idling-up correction value $Q_{ELS}$=K1 correlated to the radiator driving duty (load value) under duty-driving the fan determined by a cooling water-temperature sensor and a vehicle speed is obtained in step S3. The idling-up correction value $Q_{ELS}$ under duty-driving of the fan is obtained from the correlation map between a predetermined fan driving duty (%) and the idling-up correction value $Q_{ELS}$ or from a formula $Q_{ELS}=K_{ELS}\times\text{FanDuty}$ by assuming that the idling-up correction value $Q_{ELS}$ is proportional to a fan driving duty and the idling-up correction value $Q_{ELS}$ at a fan driving duty of 100% is equal to $K_{ELS}$, and a fan driving duty is FanDuty (%) to assume the result as K1.

When the correcting operation routine F1 is completed, step S4 is started, and the actual speed Ne of the engine 1 is computed in accordance with the rotation cycle of the engine 1 computed by a not-illustrated interrupt routine. Then, in step S5, a target engine speed Nt corresponding to the operation state of the engine 1 is computed. The target engine speed Nt is computed in accordance with cooling-water temperature WT obtained from the cooling-water temperature sensor 14 and a condition in which a torque converter signal input from the torque converter switch 16 is an off-signal (neutral range) or on-signal (drive range). In step S6 likewise S5, a basic air quantity $Q_{BASE}$ corresponding to an operation state is computed in accordance with a cooling-water temperature WT and a torque converter signal.

Then, in step S7, it is decided whether a vehicle is in a state of being stopped in which the idling switch 9 is turned on and the speed sensor 17 does not generate any pulses, that is, whether the vehicle is in an idling state. Unless the idling state is set, the step jumps to S10. When it is in the idling state, it is decided in step S8 whether the timing for engine-speed feedback correction every 100 ms is set. Unless the timing is set, the step jumps to S10. When the timing is set, step S9 is started to compute an engine-speed feedback correction value $Q_{NFB}$.

Figure 5:
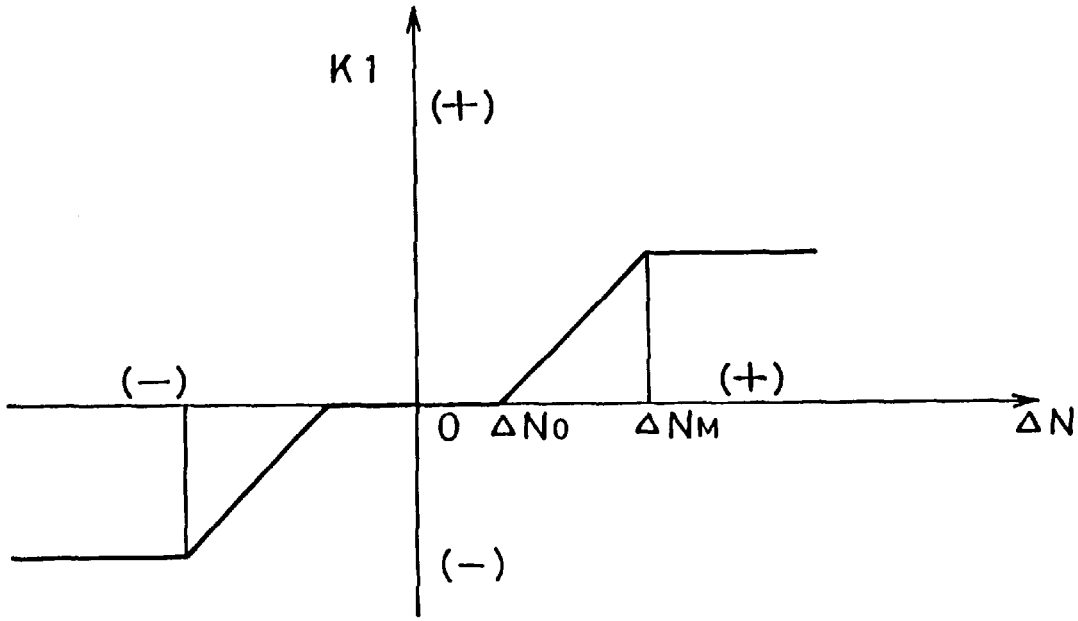
FIG. 5 is an illustration showing the relation between deviation ΔN of engine speed and control gain K1.
Figure 6:
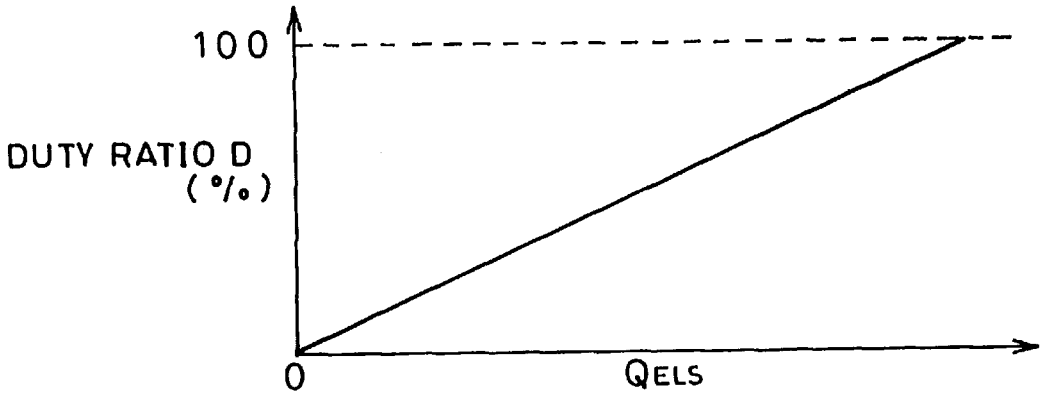
FIG. 6 is an illustration showing the relation between idling-engine-speed control air quantity $Q_{ISC}$ and duty ratio D.
Figure 7:
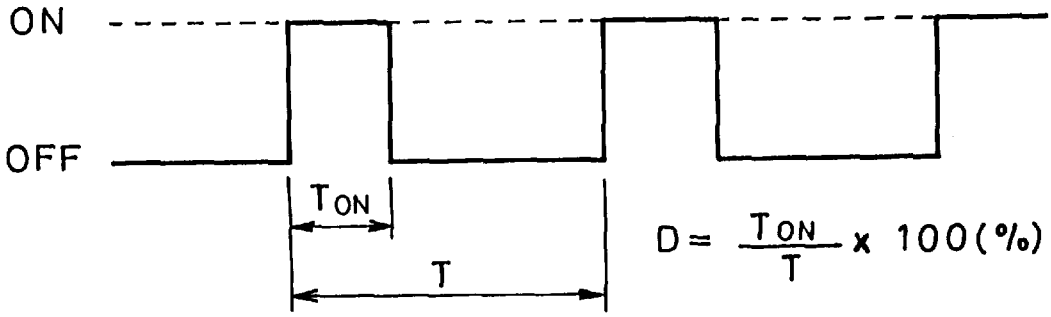
FIG. 7 is an illustration for explaining duty ratio D.

In step S9, the deviation ΔN between the actual engine speed Ne obtained in step S4 and the target engine speed Nt obtained in step S5 is computed and a control gain K1 corresponding to the deviation ΔN is computed in accordance with a one-dimensional map of the deviation ΔN and a control gain K1 for converging the engine speed Ne to the target engine speed Nt. FIG. 5 is an illustration showing a one-dimensional map for obtaining the control gain K1 from the deviation ΔN, in which the control gain K1 is kept at 0 (dead band) when the absolute value of the deviation ΔN ranges between 0 and $\Delta N_0$ and the control gain K1 becomes a value proportional to $(\Delta N-\Delta_0)$ when the absolute value of the deviation ΔN exceeds $\Delta N_0$. Moreover, when the absolute value of the deviation ΔN exceeds a preset maximum deviation $\Delta N_M$, K1 becomes a constant value. Then, a value obtained by adding the control gain K1 to the last value (value 100 msec before) of the engine-speed feedback correction value $Q_{NFB}$ is obtained to update the engine-speed feedback correction value $Q_{NFB}$.

In step S10, the basic air quantity $Q_{BASE}$ computed in step S6, engine-speed feedback correction value $Q_{NFB}$ computed in step S9, and idling-up correction value $Q_{ELS}$ under duty-diving of the radiator fan computed in step S3 are added each other to compute an idling-engine-speed control air quantity $Q_{ISC}$. In step S11, a duty ratio D corresponding to the above-computed idling-engine-speed control air quantity $Q_{ISC}$ is computed in accordance with the map of the idling-engine-speed control air quantity $Q_{ISC}$ and the duty ratio D (%) of a driving signal to be applied to the air control valve 11. Moreover, the duty ratio D can be obtained from $T_{ON}/T\times100[100]$ by assuming the cycle of a driving signal as T and the on-time in one cycle as $T_{ON}$. Moreover, after the processing in step S11, the idling-engine-speed control routine is completed and after return, step S1 is restarted to repeat the above operations.

Figure 3:
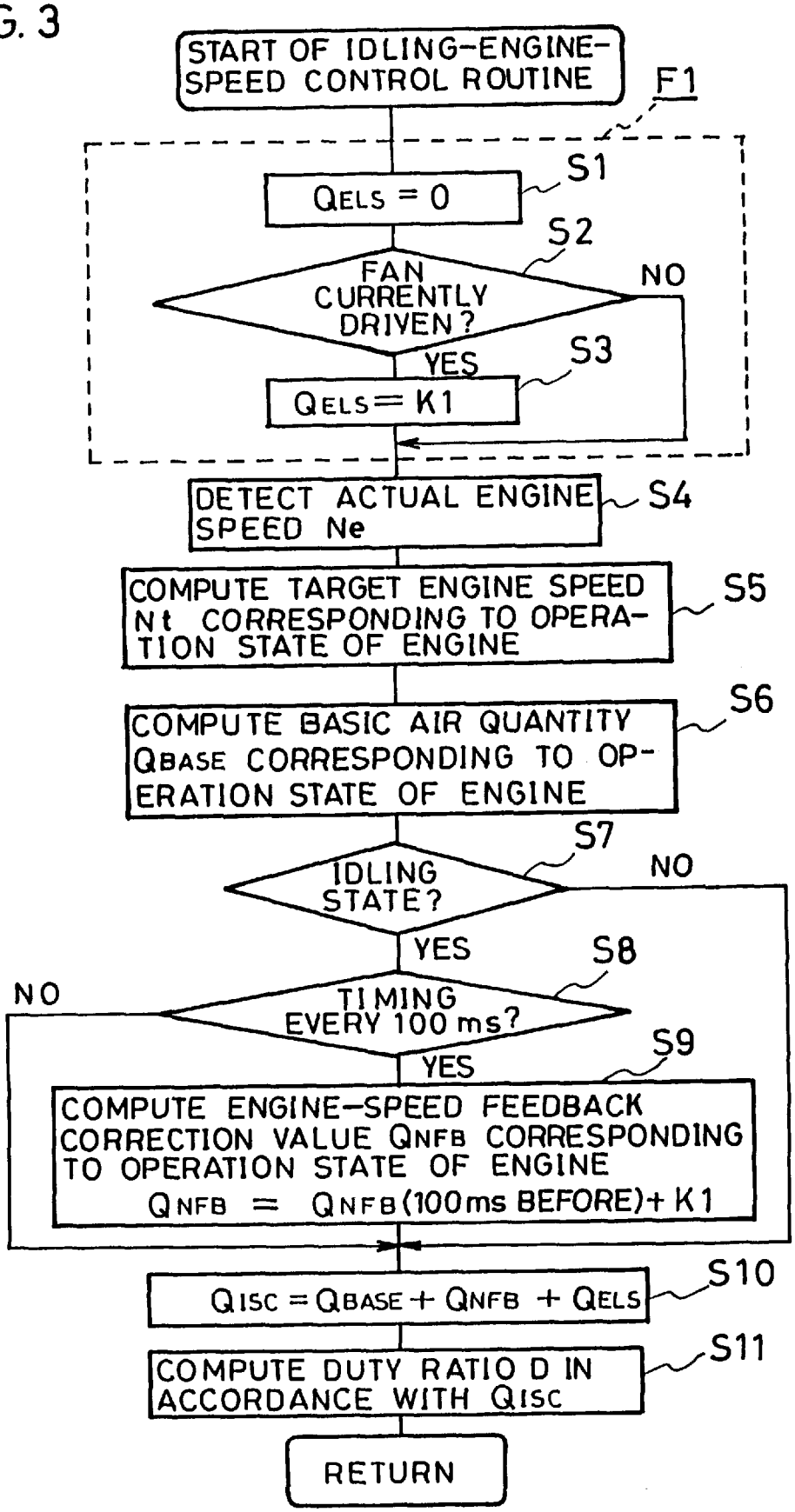
FIG. 3 is a flow chart showing the idling-engine-speed control operation of embodiment 1 of the present invention.
Figure 8:
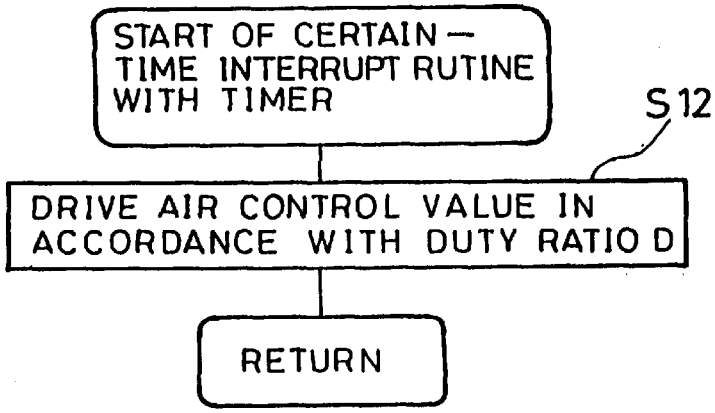
FIG. 8 is a flow chart showing the interrupt processing routine of embodiment 1 of the present invention.

Moreover, FIG. 8 is a flow chart showing an interrupt processing routine every millisecond, in which a driving signal having the duty ratio D obtained by the operation program shown in FIG. 3 is transmitted to the air control valve 11 through the first output interface circuit 104 to drive the air control valve 11 (step S12) and then, the step is returned.

Figure 9:
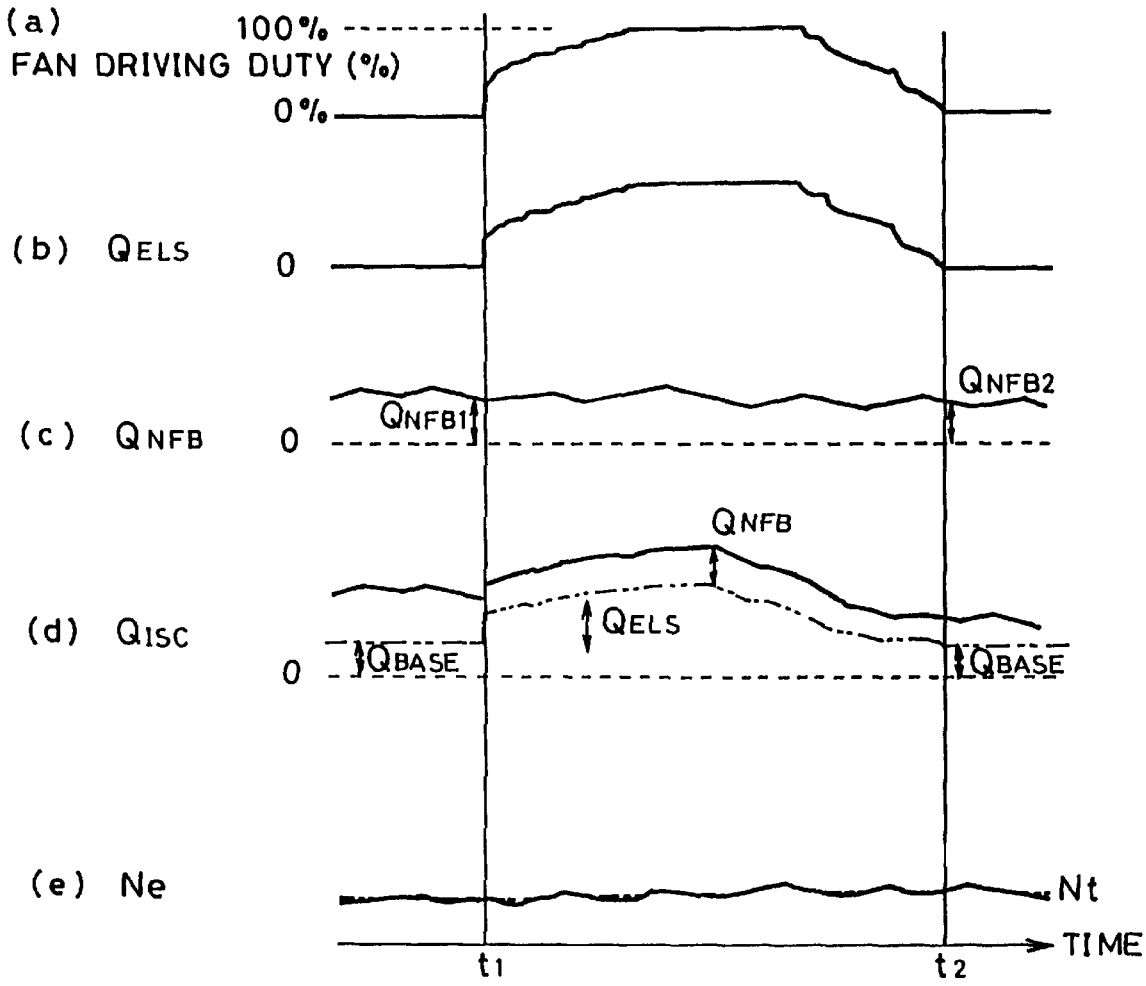
FIG. 9(*a–e*) shows time charts of idling-engine-speed control air quantity $Q_{ISC}$ and actual engine speed Ne of embodiment 1 of the present invention.

FIGS. 9(*a*) to 9(*e*) are illustrations showing temporal changes of an idling-up correction value $Q_{ELS}$ under duty-driving, idling-engine-speed control air quantity $Q_{ISC}$, and actual engine speed Ne when an electric load value (driving duty value) increases because a radiator fan serving as an electric load device to be duty-driven is operated. The $Q_{ELS}$ denotes the idling-up correction value $Q_{ELS}$ under duty-driving obtained by the correcting operation routine F1 and the $Q_{ISC}$ denotes the idling-engine-speed control air quantity $Q_{ISC}$ obtained by the idling-engine-speed control routine (FIG. 3).

Because of the increase of an electric load value (driving duty value) since the input time $t_1$ of the electric load value, the idling-engine-speed control air quantity $Q_{ISC}$ becomes a value obtained by adding the sum of the basic air quantity $Q_{BASE}$ and the engine-speed feedback correction value $Q_{NFB}$ to K1 which is the idling-up correction value $Q_{ELS}$ under duty-driving of a radiator fan.

Because the idling-up correction value $Q_{ELS}$=K1 is a value computed in accordance with a radiator-fan driving duty value, the idling-up correction value $Q_{ELS}$ at time $t_1$ has neither excess nor deficiency and therefore, the idling-engine-speed control air quantity $Q_{ISC}$ also becomes a value corresponding to the loaded state of an electric load device. Thus, as shown in FIG. 9(*e*), decrease or increase of the actual engine speed Ne under radiator fan driving does not occur. Moreover; as shown in FIG. 9(*b*), because the idling-up correction value $Q_{ELS}$=K1 changes by following the change of a radiator-fan driving duty {FIG. 9(*a*)}, the engine-speed feedback correction value $Q_{NFB}$ also becomes almost constant as shown in FIG. 9(*c*) and the actual engine speed Ne stably keeps a value equal to the target engine speed Nt independently of a load change as shown in FIG. 9(*e*).

Moreover, even if the above electric load is released at time $t_2(t_2>t_1)$, the engine speed Ne keeps a stable state independently of whether an electric load is input or released as shown in FIG. 9(*e*) because an engine-speed feedback correction value $Q_{NFB2}$ at time $t_2$ is almost equal to a engine-speed feedback correction value $Q_{NFB1}$ at time $t_1$.

Thus, according to this embodiment 1, the idling-up correction value $Q_{ELS}$ under fan duty driving is obtained as an idling-up correction value K1 corresponding to a fan driving duty and the idling-engine-speed control air quantity $Q_{ISC}$ is corrected. Therefore, excess or deficiency of an intake air quantity of an engine under input of a load does not occur or decrease or increase of the actual engine speed Ne under radiator fan driving does not occur. Moreover, the engine-peed feedback correction value $Q_{NFB1}$ under input of a load or engine-speed feedback correction value $Q_{NFB2}$ under release of the load is not increased or decreased. Therefore, the idling-engine-speed control air quantity $Q_{ISC}$ under release of a load does not excessively increase or hunting or increase of the actual engine speed Ne under radiator-fan driving does not occur. Moreover, even if duty values change with passage of time under operation ($t_1$ to $t_2$), it is possible to stably keep the engine speed Ne independently of a loaded state because the idling-up correction value K1 under fan duty-driving correlated to a radiator-fan driving duty is used as the idling-up correction value $Q_{ELS}$.

Embodiment 2

For the embodiment 1, a case is described in which an electric load device to be duty-driven is only the radiator fan 23. However, when a plurality of electric load devices (n devices) is used, it is possible to obtain a proper idling-up correction value $Q_{ELS}$ corresponding to a driving duty value and stabilize the engine speed under idling by using electric-load correction-value computing means for each electric load device to be duty-driven, computing an electric-load correction value $Q_{ELSi}$ (I=1, 2, . . . , n) for each electric load device, and replacing the correcting operation routine with a correcting operation routine using the sum of the computed results as the idling-up correction value $Q_{ELS}$.

Figure 10:
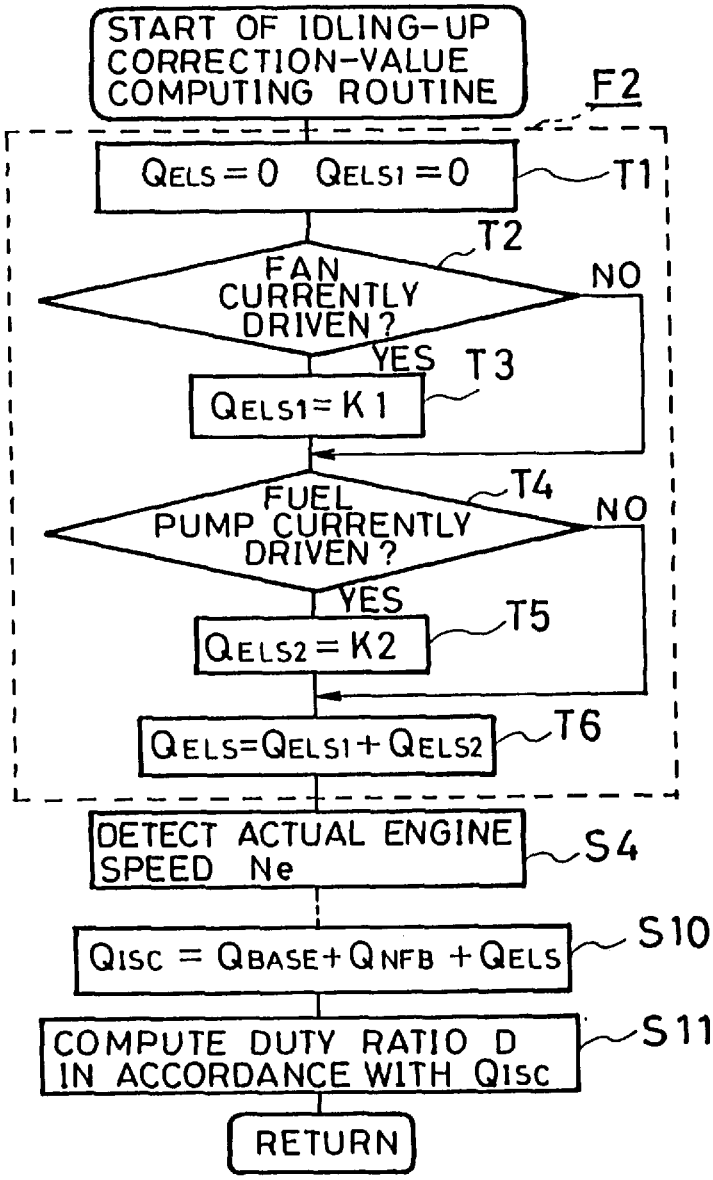
FIG. 10 is a flow chart showing the correcting operation routine F2 of embodiment 2 of the present invention.

FIG. 10 is an illustration showing an correcting operation routine F2 when the radiator fan 23 serving as an electric load device and the fuel pump 24 are driven, in which, in step T1, idling-up correction values $Q_{ELS1}$ and $Q_{ELS2}$ of the radiator fan 23 and fuel pump 24 under duty driving are first initialized to 0.

Figure 4:
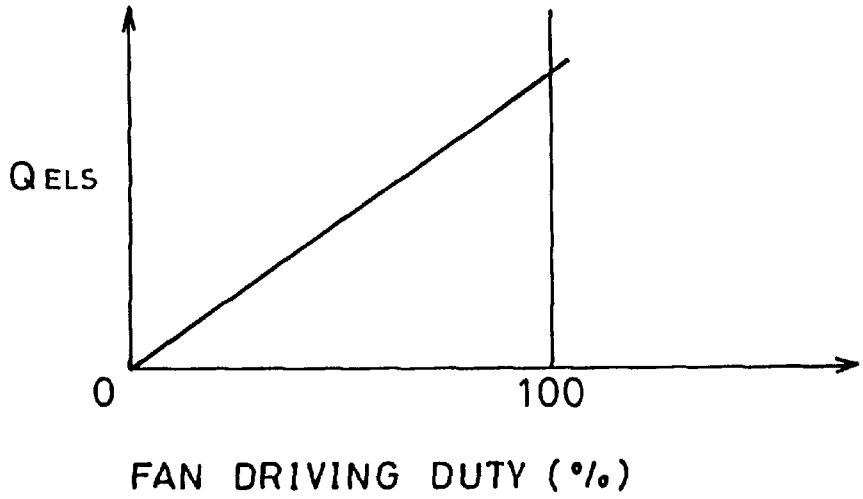
FIG. 4 is an illustration showing the relation between idling-up correction value and fan driving duty under duty-driving of a fan.

Then, in step T2, it is decided whether a radiator fan is currently driven. Unless the radiator fan is currently driven, step T4 is started. When the radiator fan is currently driven, the idling-up correction value QELS1=K1 of the driving duty is obtained in step T3 from a correlation map with the idling-up correction value $Q_{ELS1}$ under duty-driving of the fan correlated to a radiator-fan driving duty (load value) determined by the fan driving duty in FIG. 4, the water-temperature lowering sensor 14, and a vehicle speed or obtained from a formula $Q_{ELS1}=K_{ELS1}\times$FandDuty by assuming that the idling-up correction value $Q_{ELS1}$ is proportional to a fan driving duty, the idling-up correction value $Q_{ELS1}$ is $K_{ELS1}$, and the idling-up correction value $Q_{ELS1}$ at a fan driving duty of 100% is FanDuty (%) to assume the result as K1.

Figure 11:
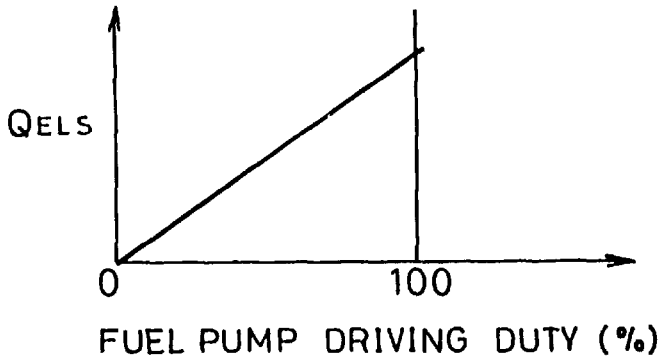
FIG. 11 is a flow chart showing the correcting operation routine F3 of embodiment 3 of the present invention.

Then, in step T4, it is decided whether a fuel pump is currently duty-driven. Unless the fuel pump is currently duty-driven, step T6 is started. When the fuel pump is duty-driven, the idling-up correction value $Q_{ELS2}$=K2 of the driving duty is obtained in step T5 from the correlation map of the idling-up correction value $Q_{ELS2}$ under duty-driving of a fuel pump correlated with a fuel-pump driving duty (load value) determined by the fuel pump driving duty in FIG. 11 and a fuel pressure or from a formula $Q_{ELS2}=K_{ELS2}$ by assuming that the idling-up correction value $Q_{ELS2}$ is proportional to a fuel pump driving duty, the idling-up correction value $Q_{ELS2}$ at a fan driving duty of 100% is $K_{ELS2}$, and the fuel pump driving duty is PomDuty (%) to assume the result as K2. Moreover, in step T6, an idling-up correction value $Q_{ELS}$ is computed by adding the idling-up correction value $Q_{ELS1}$ under duty-driving of the fan and the idling-up correction value $Q_{ELS2}$ under duty-driving of the fuel pump. After the processing in step T6, the correcting operation routine F2 is completed and step S4 is started to compute an idling-engine-speed control air quantity $Q_{ISC}$ similarly to the case of the embodiment 1.

Embodiment 3

In the case of the embodiment 2, the correcting operation is described in which an electric load correction value $Q_{ELSi}$ (i=1, 2, . . . , n) is computed for each electric load device to be duty-driven and the sum of the operation results is used as the idling-up correction value $Q_{ELS}$. When one of the electric load correction values $Q_{ELSi}$ sufficiently corresponds to a driving duty (load value), it is possible to stabilize the engine speed under idling by using the maximum correction value $Q_{ELSM}$ among the correction values $Q_{ELSi}$ as the idling-up correction value $Q_{ELS}$.

Figure 12:
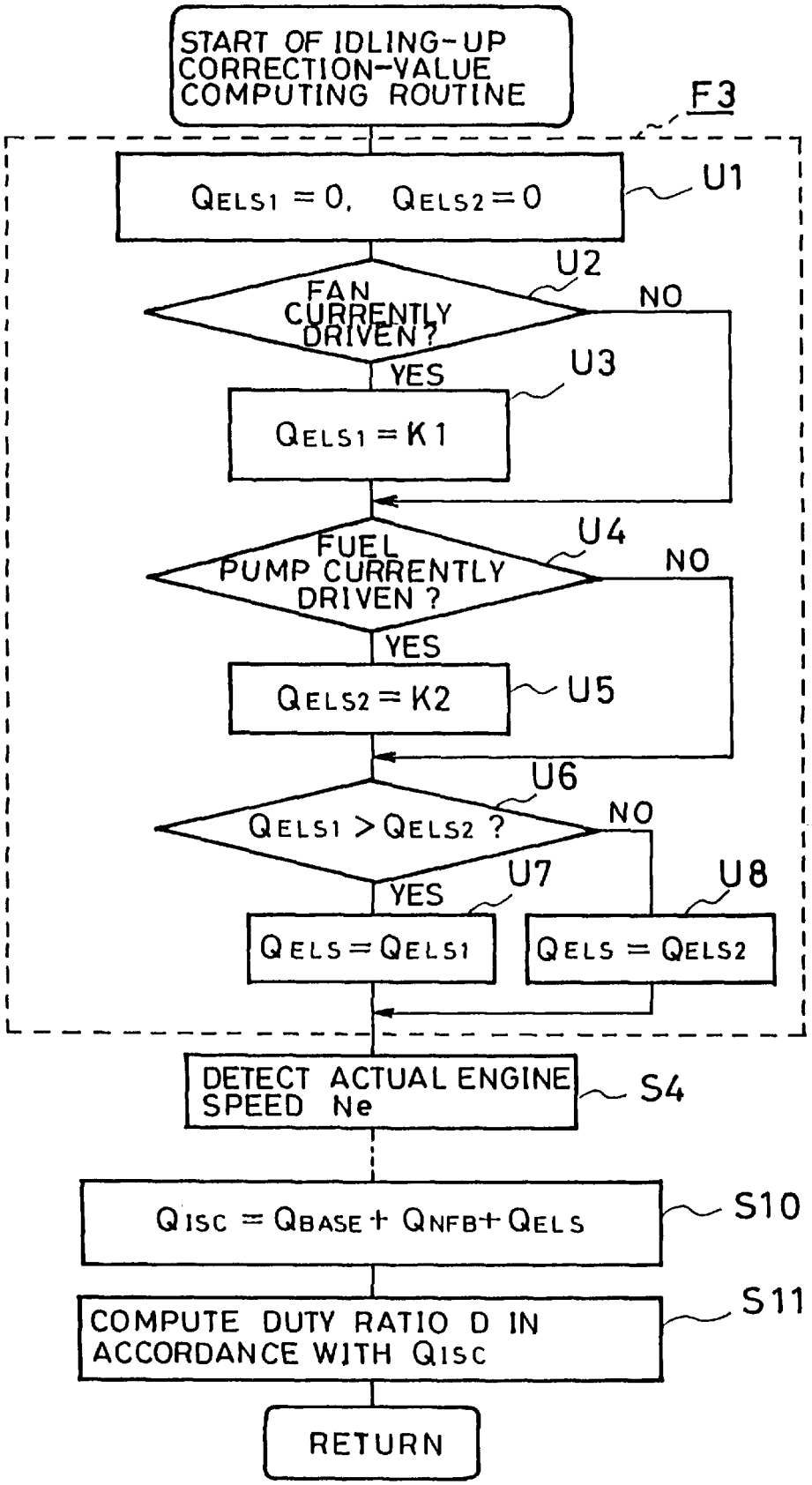
FIG. 12 is an illustration showing the relation between idling-up correction value and fan driving duty under duty-driving of a fuel pump.
Figure 13:
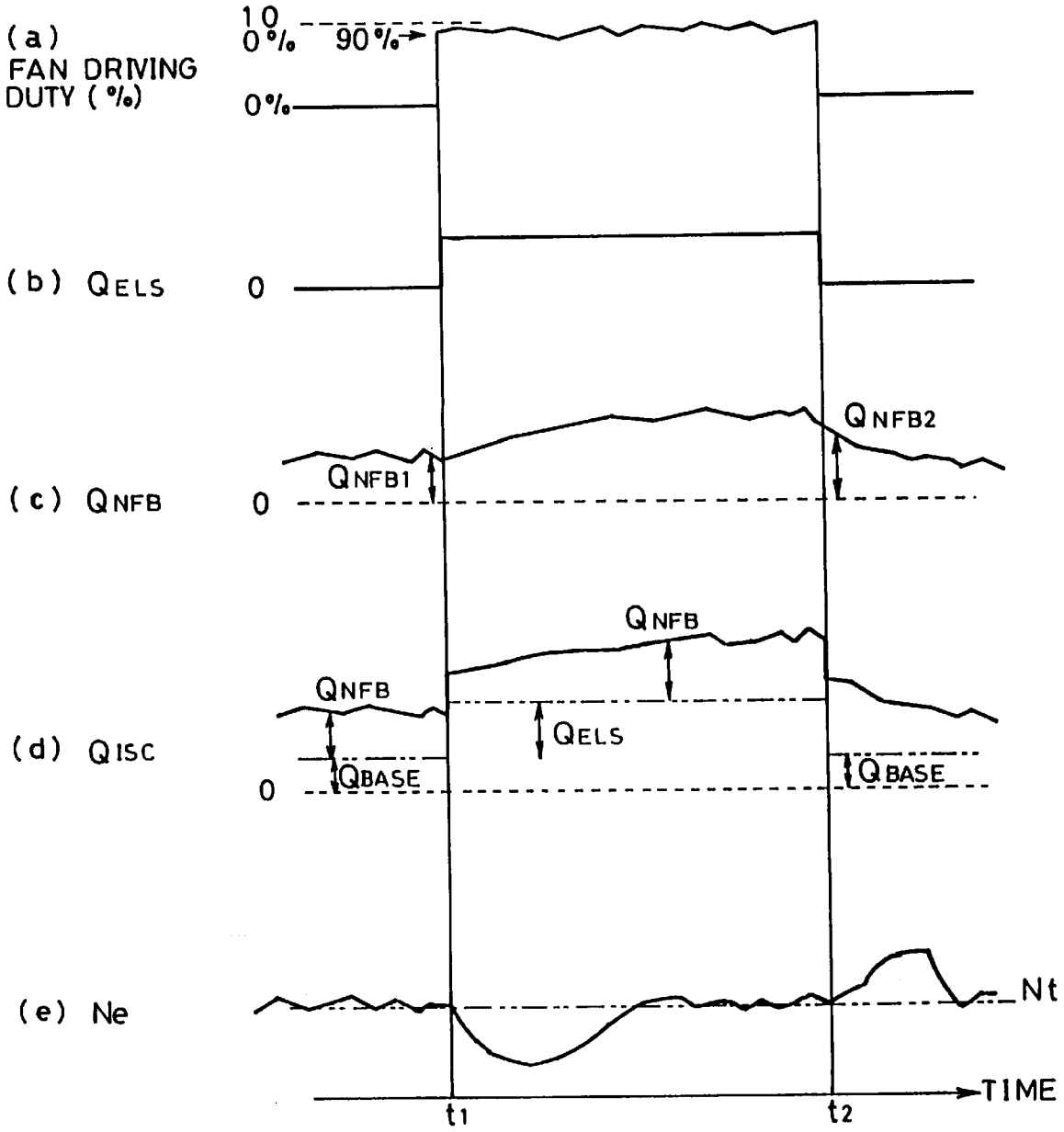
FIG. 13 PRIOR ART
FIG. 13(*a–e*) shows time charts of idling-engine-speed control air quantity $Q_{ISC}$ and actual engine speed Ne of a conventional engine speed control method.

FIG. 12 is an illustration showing the correcting operation routine F3 when the radiator fan 23 and the fuel pump 24 are driven as electric load devices. In FIG. 12, steps U1 to U5 are steps for computing an idling-up correction value $Q_{ELS1}$ under duty-driving of the fan and an idling-up correction value $Q_{ELS2}$ under duty-driving of the pump similarly to steps T1 to T5 of the embodiment 2. When the radiator fan 23 or fuel pump 24 is not driven, the idling-up correction value $Q_{ELS1}$ or $Q_{ELS2}$ is kept initialized to 0.

In step U6, the idling-up correction value QELS1 under duty-driving the fan and the idling-up correction value $Q_{ELS2}$ under duty-driving of the fuel pump are compared each other in magnitude. When $Q_{ELS1}>Q_{ELS2}$ is effected, the idling-up correction value $Q_{ELS}$ is made equal to $Q_{ELS1}$ in step U7. When $Q_{ELS1}>Q_{ELS2}$ is not effected, the idling-up correction value $Q_{ELS}$ is made equal to $Q_{ELS2}$. After the processing in step U7 or U8, the correcting operation routine F3 is completed and step S4 is started to compute an idling-engine-speed control air quantity $Q_{ISC}$ similarly to the case of the embodiment 1.

In the case of the above embodiments 2 and 3, the idling-up correction value $Q_{ELS}$ is obtained as $Q_{ELS}(2)=Q_{ELS1}+Q_{ELS2}$ or $Q_{ELS}(3)=\mathrm{Max}(Q_{ELS1}, Q_{ELS2})$. However, it is also possible to use a value obtained by combining the $Q_{ELS}(2)$ and $Q_{ELS}(3)$ such as $Q_{ELS}=A\cdot Q_{ELS}(2)+B\cdot Q_{ELS}(3)$ (A and B are constants set by a system) as the idling-up correction value $Q_{ELS}$ depending on the type of a load device to be driven or the capacity of an engine. Moreover, it is possible to use a value obtained by weighting the electric load correction values $Q_{ELS1}$ and $Q_{ELS2}$ such as $Q_{ELS}=a\cdot Q_{ELS1}+b\cdot Q_{ELS2}$ (a and b are constants set in accordance with types of electric load devices) as the idling-up correction value $Q_{ELS}$.

Moreover, for the above example, a case is described in which the radiator fan 23 and fuel pump 24 are driven as electric load devices. However, even when three electric load devices or more are used, it is needless to say that the engine speed under idling can be stabilized by obtaining the idling-up correction value $Q_{ELS}$ through the same operation and correcting the idling-engine-speed control air quantity $Q_{ISC}$.

As described above, the engine speed control method makes it possible to prevent the engine speed under idling from excessively increasing or decreasing because the speed of an engine is controlled by correcting an intake air quantity used to control the engine speed under idling in accordance with the driving duty value of an electric load device when duty-driving the electric load device.

Moreover, the engine speed control method makes it possible to quickly stabilize the engine speed under idling because the loaded state of an electric load device is detected correspondingly to an duty value output to the electric load device.

The engine-speed controller makes it possible to stabilize the actual engine speed under idling because the controller is provided with electric-load correction value computing means for computing a correction value of an intake air quantity used to control the engine speed under idling corresponding to the loaded state of an electric load device to be duty-driven because the speed of an engine is controlled by adjusting the intake air quantity of the engine in accordance with the correction value obtained by the electric-load correction-value computing means.

Moreover, the engine speed controller makes it possible to properly obtain a loaded-state electric-load correction value because the above loaded state is detected in accordance with the duty output value of a circuit to be duty-driven.

Furthermore, the engine speed controller makes it possible to stabilize the actual engine speed under idling even when a plurality of electric load devices to be duty-driven is used because the above electric load correction-value computing means is provided for each electric load device to be duty-driven.

Furthermore, the engine speed controller makes it possible to stabilize the actual engine speed under idling because the sum of electric load correction values computed by electric-load correction-value computing means provided for a plurality of electric load devices is used as a correction value of an idling-engine-speed control air quantity and thereby, the electric-load correction values do not become insufficient even when a plurality of the electric load devices are simultaneously driven.

Furthermore, the engine speed controller makes it possible to stabilize the actual engine speed under idling at a minimum electric-load correction value because the maximum electric-load correction value among the electric-load correction values computed by electric-load correction-value computing means provided for a plurality of electric load devices is used as a correction value of an idling-engine-speed control air quantity.

Furthermore, the engine speed controller makes it possible to obtain an electric-load correction value corresponding to the type of an electric load device to be driven or the capacity of an engine because a correction value of an idling-engine-speed control air quantity is computed in accordance with the sum of the electric-load correction values obtained by electric-load correction-value computing means provided for a plurality of electric load devices and the maximum correction value among the output correction values computed by the electric-load correction-value computing means.

Furthermore, the engine speed controller makes it possible to further properly obtain an electric-load correction value because a value obtained by weighting and summing the electric-load correction values obtained by electric-load correction-value computing means provided for a plurality of electric load devices is used as a correction value of an idling-engine-speed control air quantity.

What is claimed is:

1. An engine speed control method comprising the step of correcting an intake air quantity to be used to control the engine speed under idling in accordance with the driving duty value of an electric load device when driving said electric load device.

2. The engine speed control method according to claim 1, wherein a loaded state is detected correspondingly to the duty output value for an electric load device.

3. An engine speed controller comprising an electric load device to be duty-driven and a circuit for duty-driving said electric load device, wherein electric-load correction-value computing means is included which computes a correction value of an intake air quantity to be used to control the engine speed under idling corresponding to the loaded state of said electric load device when applying a duty output to said duty-driving circuit and an idling-engine-speed control air quantity is corrected in accordance with said electric-load correction value.

4. The engine speed controller according to claim 3, wherein said loaded state is detected in accordance with the duty output value of a circuit for duty-driving an electric load device.

5. The engine speed controller according to claim 3, wherein said electric-load correction-value computing means is used for each electric load device to be duty-driven when a plurality of electric load devices to be duty-driven are used.

6. The engine speed controller according to claim 5, wherein the sum of each electric-load correction value computed by each electric-load correction-value computing means is used as a correction value of an intake air quantity to be used to control the engine speed under idling.

7. The engine speed controller according to claim 5, wherein the maximum electric-load correction value among each electric-load correction value computed by each electric-load correction-value computing means is used as a correction value of an intake air quantity to be used to control the engine speed under idling.

8. The engine speed controller according to claim 5, wherein a correction value of an intake air quantity used to control the engine speed under idling is computed in accordance with the sum of each electric-load correction value obtained by each electric-load correction-value computing means and the maximum output correction value among the output correction values computed by each electric-load correction-value computing means.

9. The engine speed controller according to claim 5, wherein a value obtained by weighting the electric-load correction values obtained by each electric-load correction-value computing means and summing them is used as a correction value of an intake air quantity used to control the engine speed under idling.

* * * * *